US008141735B2

(12) United States Patent
Woods et al.

(10) Patent No.: US 8,141,735 B2
(45) Date of Patent: Mar. 27, 2012

(54) CONTAINER FOR HOLDING FOODSTUFFS

(75) Inventors: Timothy Paul Woods, Cambridge (NZ); Lawrence Basil Hart, Auckland (NZ)

(73) Assignee: Durapod System Limited, Auckland (NZ)

( * ) Notice: Subject to any disclaimer, the term of this patent is extended or adjusted under 35 U.S.C. 154(b) by 1324 days.

(21) Appl. No.: 10/568,365

(22) PCT Filed: Aug. 11, 2004

(86) PCT No.: PCT/NZ2004/000180

§ 371 (c)(1),
(2), (4) Date: Apr. 19, 2007

(87) PCT Pub. No.: WO2005/016079

PCT Pub. Date: Feb. 24, 2005

(65) Prior Publication Data

US 2007/0267432 A1 Nov. 22, 2007

(30) Foreign Application Priority Data

Aug. 14, 2003 (NZ) ..... 527588

(51) Int. Cl.
*B65D 43/14* (2006.01)

(52) U.S. Cl. ..... 220/252; 220/832; 220/826; 16/354; 232/43.1; 232/44; 292/80; 292/DIG. 11

(58) Field of Classification Search ..... 220/252, 220/254.3, 254.5, 826, 831, 832; 222/185.1, 222/478; 221/15, 28, 269, 281; 232/1 R, 232/43.1, 44; 16/54, 286, 354; 312/321; 292/80, DIG. 11, DIG. 15, DIG. 80
See application file for complete search history.

(56) References Cited

U.S. PATENT DOCUMENTS

| | | | | |
|---|---|---|---|---|
| 1,300,710 | A * | 4/1919 | Edwards | 220/252 |
| 4,399,928 | A | 8/1983 | Klingler | |
| 4,697,673 | A | 10/1987 | Omata | |
| 4,940,191 | A * | 7/1990 | Dolby | 229/125 |
| 5,102,002 | A * | 4/1992 | Whitley | 220/823 |
| 5,361,927 | A * | 11/1994 | Frei | 220/827 |
| 6,015,173 | A * | 1/2000 | Shang | 292/288 |
| 6,758,366 | B2 | 7/2004 | Bourgund et al. | |
| 2003/0080131 | A1 * | 5/2003 | Fukuo | 220/264 |
| 2003/0132234 | A1 | 7/2003 | Hirose | |

OTHER PUBLICATIONS

Search report mailed Nov. 9, 2004 for International Application No. PCT/NZ/2004/000180.

* cited by examiner

*Primary Examiner* — Anthony Stashick
*Assistant Examiner* — James N Smalley
(74) *Attorney, Agent, or Firm* — Wolf, Greenfield & Sacks, P.C.

(57) ABSTRACT

The invention relates to a novel container (1) for holding foodstuffs. The container is of the type used for a holding bulk food product to be dispensed by a self serving customer in the bulk food section of a supermarket or health food establishment. The container includes a self closing lid (2) and is specially shaped to avoid the existence of a "dead space" which can lead to product in that portion becoming stale.

18 Claims, 10 Drawing Sheets

CONTAINER FOR HOLDING FOODSTUFFS

Figure 1:
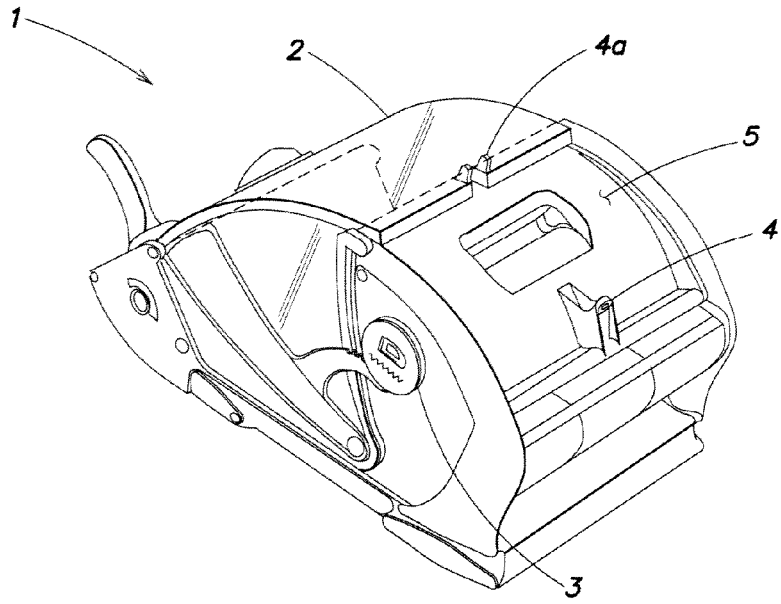

The present invention relates to a container for holding foodstuffs, particularly, improvements relating to containers for holding foodstuffs such as nuts, seeds, pulses, snack foods, confectionery, baking ingredients, pet food and the like.

It is common for supermarkets and certain other retailers to have a bulk foods section where foodstuffs are held in bulk containers from which customers may dispense the particular quantity of the food they wish to purchase.

A problem often observed in bulk food sections or specialist bulk foodstuff stores is that customers do not always close the lids of the containers after they have dispensed the quantity they will purchase. This practice poses a serious health risk as contaminants may easily enter the container. The food held in the container may also go stale more quickly if the container is left open for long periods of time.

Another common problem associated with bulk foodstuff containers is that it is often difficult to fill the container without spilling some of the product, particularly if the container has to be filled through a small opening.

A further problem is that there is often a portion of the container that is not easily accessed by the scoop and the foodstuff may sit there for some time without being circulated and therefore become stale. The portion of the container that is not easily accessed is often referred to as "dead space".

The applicant has invented a new container for holding foodstuffs that is self-closing after a customer has dispensed the foodstuff. In addition, the applicant has invented a lid that aids in filling the container with a foodstuff whilst minimising the risk of spilling the foodstuff. Further, the container is shaped to complement the scoop shape to avoid a dead space.

According to a broad aspect, the invention provides a container for holding foodstuff, said container comprising a hollow body defining an internal space, and wherein said body has:

i) an access aperture to allow access to the internal space; and wherein the access aperture is sealed with an access lid; and wherein said access lid is connected by dampened hinging means to said body; and wherein ii) a suction cup affixed thereto which is adapted to hold the access lid in an open position for a predetermined period of time by forming a breakable seal with said access lid.

In the preferred embodiment, the body includes a charging aperture to allow the charging of foodstuff into the container, wherein said charging aperture is sealed with a charging lid which defines a funnel shape in an open position.

The charging lid preferably comprises two elements that over-lap each other. Preferably, the upper element forms an airtight seal with the body of the container.

The body has an interior floor that is shaped to complement the shape of a scoop used to dispense foodstuff held in the container so that there is no "dead space".

The body of the container has a front, a rear, two sides and a base. The access aperture is located in the front of the body and the charging aperture is preferably located in the rear of the body.

The dampened hinging means preferably comprises a dampening means which co-operates with a pinion wherein said pinion interacts with an arm which is attached to the access lid, said arm having a rack on a longitudinal edge.

Rotation of the pinion is resisted by the dampening means, which preferably contains a substance with high viscosity such as silicon grease.

The dampening means and pinion are preferably housed within a housing. The housing is preferably defined by a cylindrical depression on the side of the body.

The pinion and associated dampening means are preferably mounted on a carrier within the housing. The carrier device preferably comprises a disk including a plurality of circular apertures, each spaced at a different distance from the circumference of the disk so that the disk may be used for different sized pinions. Preferably the disk comprises three circular apertures.

The size of the pinion and the length of the rack on the arm may be selected based upon the time in which the access lid is to be closed and the weight of the access lid. A smaller pinion would be used for a larger sized lid, for example.

An end cap is preferably placed over the dampened hinging means for protection. The end cap preferably clips into the carrier.

The base of the body is preferably adapted to be attached to a display rack.

The body of the container preferably has flat sides so that a plurality of containers may be stacked side-by-side.

The top of the body of the container is preferably curved.

Preferably, the body of the container is adapted to house a scoop below the access lid.

The access lid preferably forms an air-tight seal with the container in the closed position.

One preferred embodiment of the invention will now be described in detail, with reference to the drawings.

FIG. 1: illustrates a container for holding foodstuff according to the invention with access and charging lids shown in closed positions.

Figure 2:
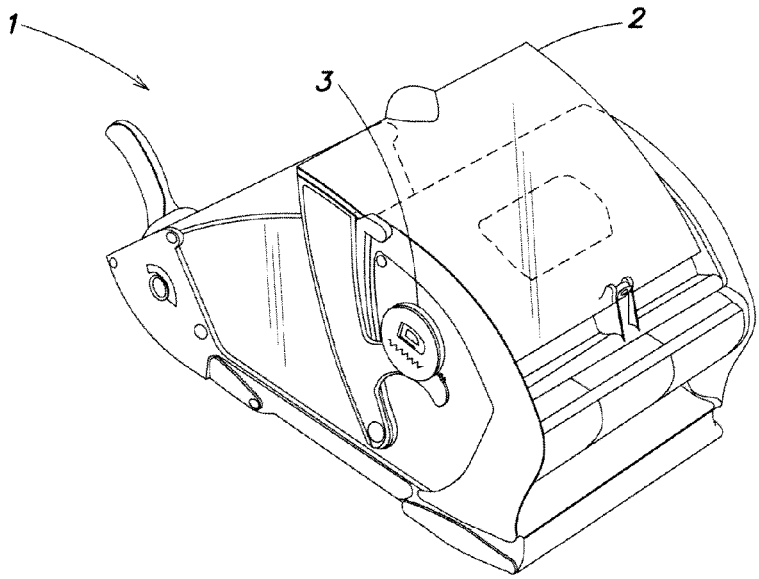

FIG. 2: illustrates the container of FIG. 1 with the access lid in the open position.

Figure 3:
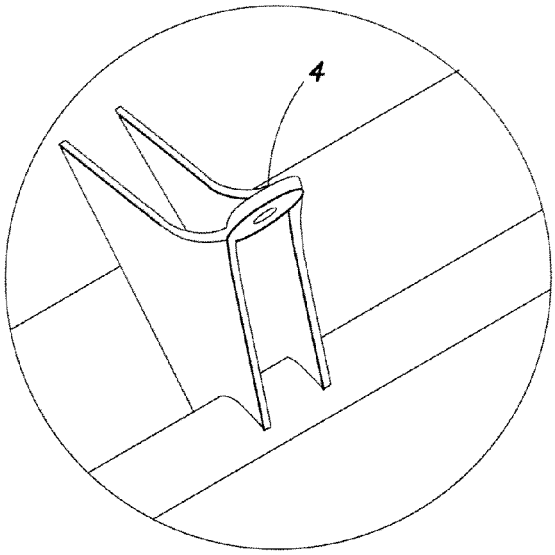

FIG. 3: illustrates a close up view of the suction cup engaging the tab on the access lid of the container illustrated in FIG. 2.

Figure 4:
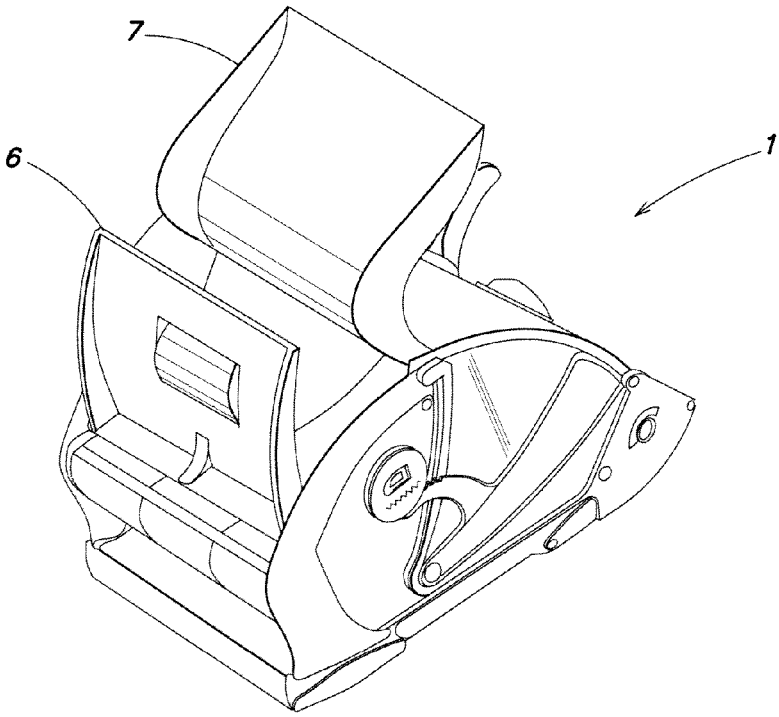

FIG. 4: illustrates a different view of the container in FIG. 1 with the charging lid in the open position.

Figure 5:
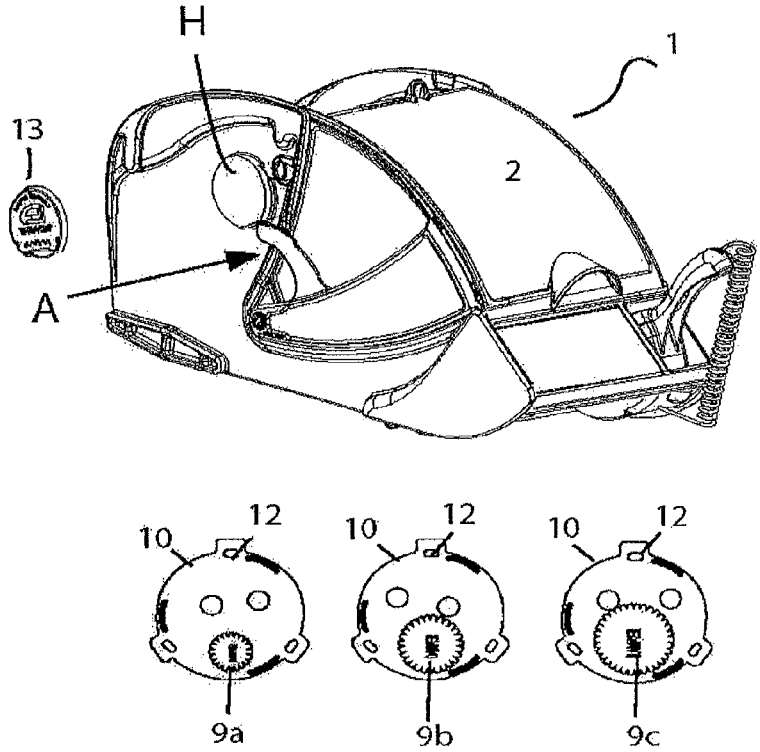

FIG. 5: illustrates the dampened hinging means of the container illustrated in FIG. 1.

Figure 6:
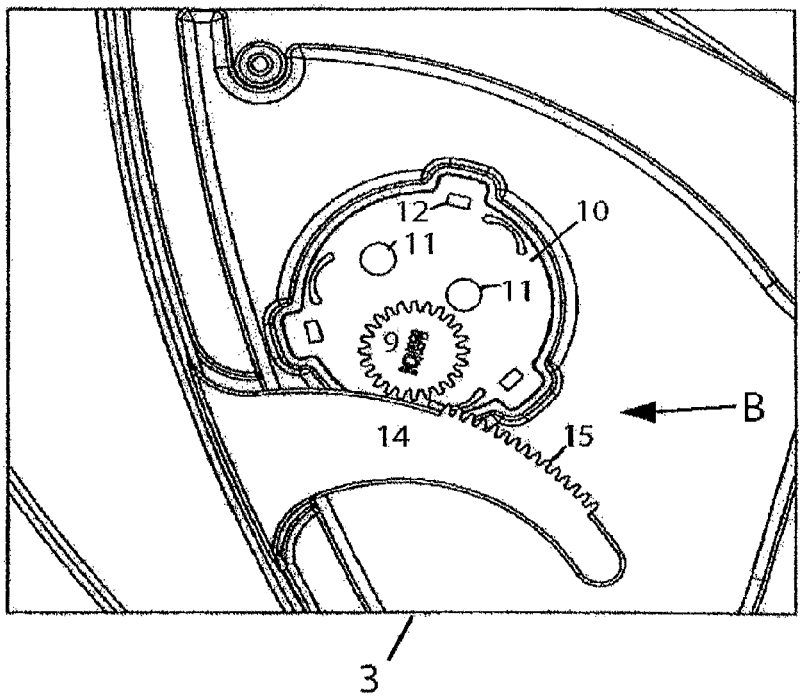

FIG. 6: illustrates the container of FIG. 1 and components of the dampened hinging means.

Figure 7:
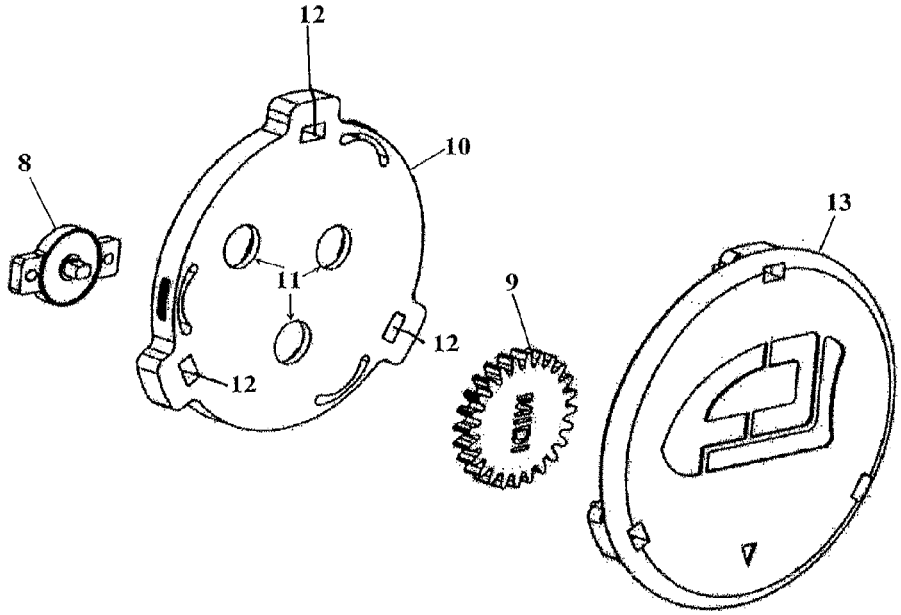

FIG. 7: illustrates components of the dampened hinging means of the container illustrated in FIG. 1.

Figure 8:
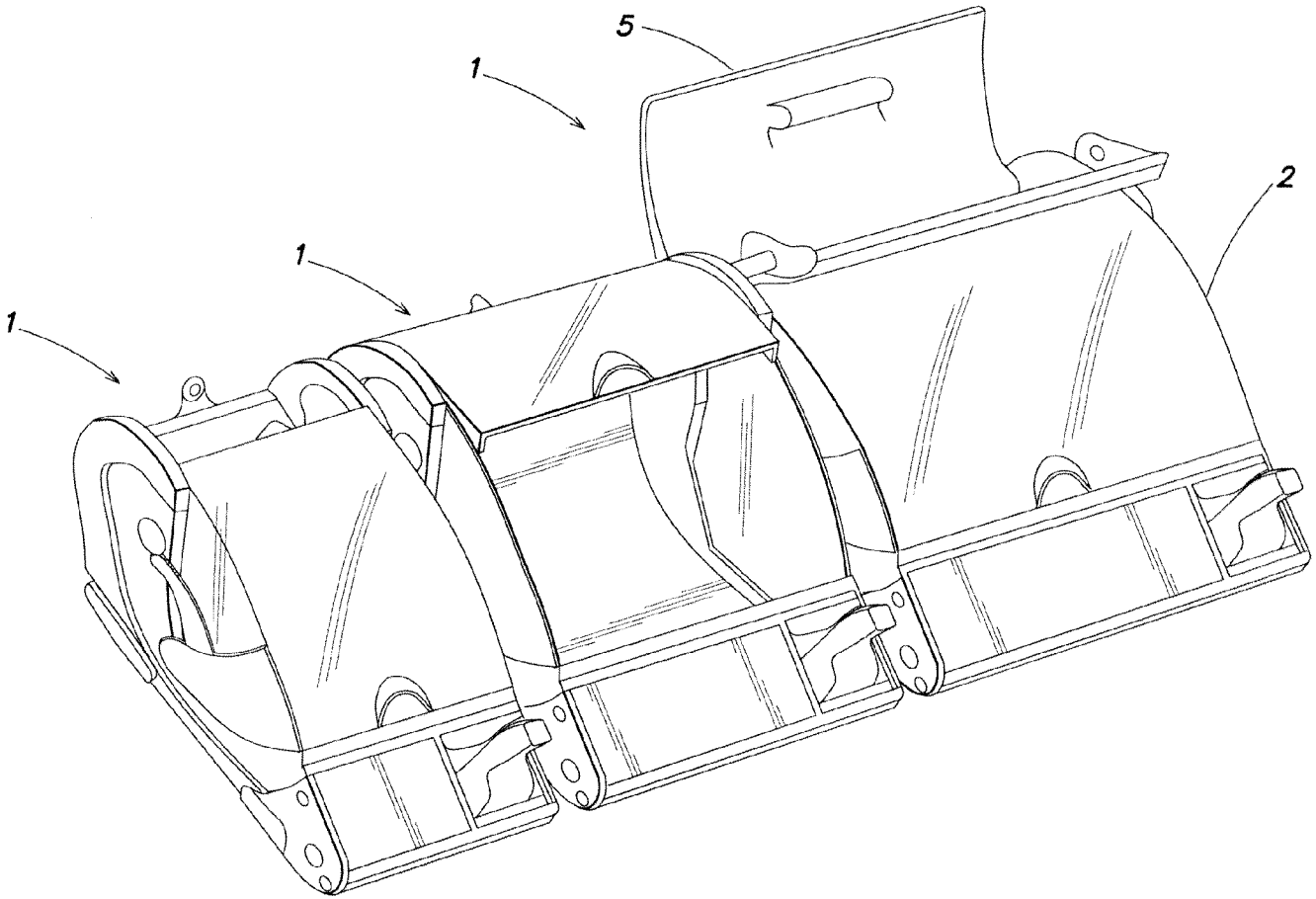

FIG. 8: illustrates a plurality of containers for holding foodstuff according to the invention with access and charging lids shown in both open and closed positions.

Figure 9:
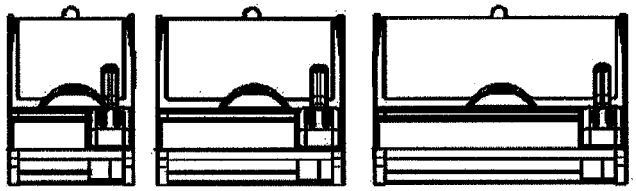

FIG. 9: illustrates different dimensions of the containers illustrated in FIG. 8.

Figure 10:
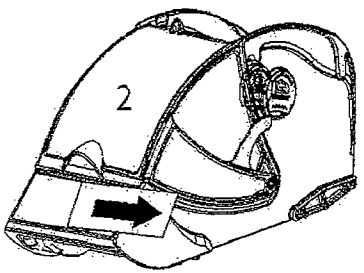
Figure 10:
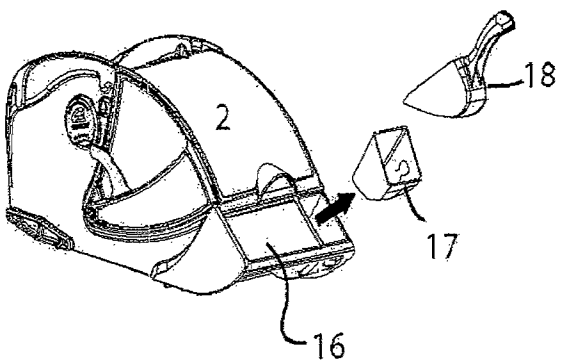
Figure 10:
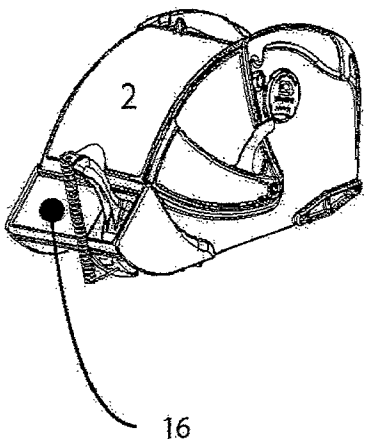

FIG. 10: illustrates the ticket strip, scoop and scoop holder of the container as illustrated in FIG. 1.

Figure 11:
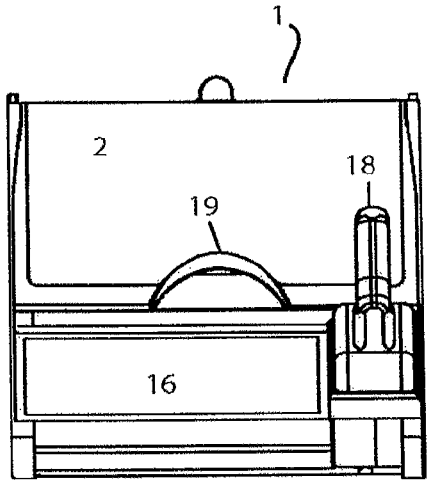

FIG. 11: illustrates another view of the container of FIG. 1.

Figure 12:
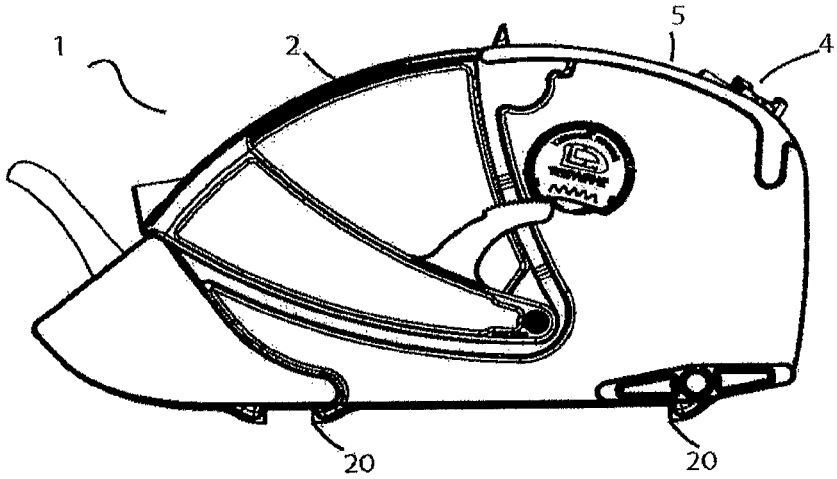

FIG. 12: illustrates the container of FIG. 1 with the access and charging lids in the closed position.

Figure 13:
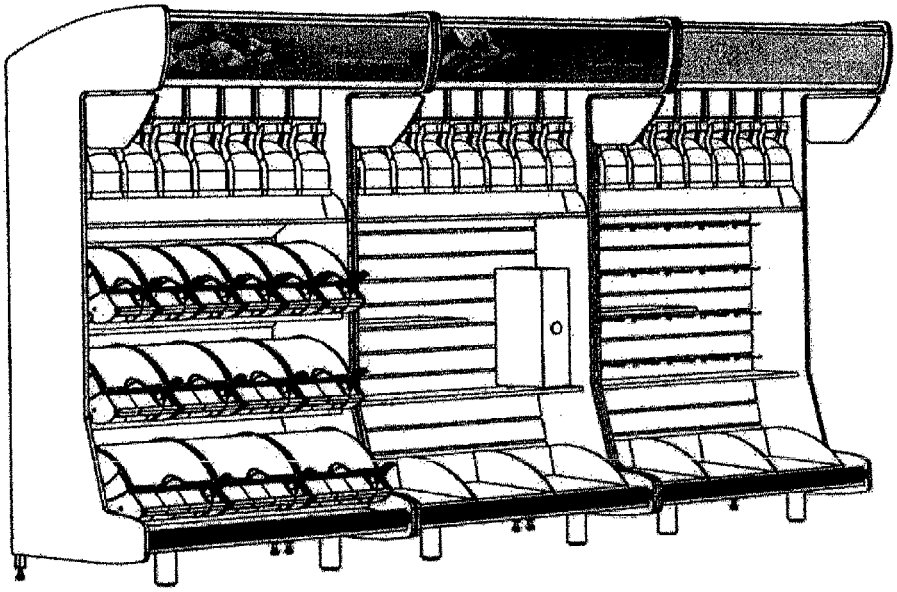

FIG. 13: illustrates a display stand for holding a plurality of containers as illustrated in FIG. 1.

Figure 14:
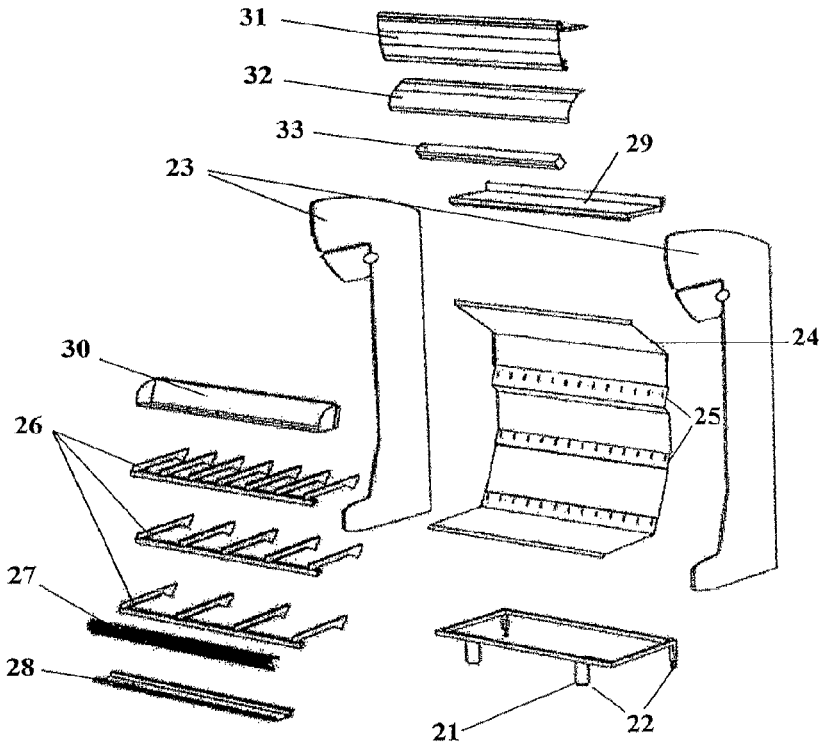

FIG. 14: illustrates the components of a display stand for holding a plurality of containers as illustrated in FIG. 1.

FIG. 1 illustrates a container 1 for holding foodstuffs, which comprises a hollow body defining an internal space. The body of the container 1 has a front, a rear, two sides and a base wherein an access aperture is located in the front of the body for accessing the foodstuff held within the body. The aperture is sealed with an access lid 2 which is connected by dampened hinging means 3 to the body. In the preferred embodiment, the lid 2 is connected to both sides of the body by a dampened hinging means 3.

A suction cup 4 is affixed to the body and is adapted to hold the access lid 2 in an open position for a pre-determined period of time by forming a breakable seal with lid 2. The suction cup 4 is positioned such that it holds the lid 2 in the open-most position. The suction cup 4 is preferably located behind the access lid 2 and preferably connects with a tab 4*a* on the access lid 2 when in the open-most position.

FIG. 2 illustrates the access lid 2 in the open-most position. FIG. 3 is a magnified picture of the suction cup 4 in connection with tab 4*a* of lid 2. When the seal of suction cup 4 is broken, the access lid 2 lowers to a closed position against the force of the dampened hinging means 3.

As illustrated in FIG. 2, the dampened hinging means 3 is preferably mounted on the outside of the container 1 to avoid interference with the foodstuff.

The access lid 2 is preferably restricted to opening to a point where the force of gravity causes the lid 2 to close when the seal is broken on the suction cup 4. The access lid 2 preferably forms an air-tight seal with the container 1 in the closed position.

Referring to FIG. 4, the body of container 1 includes a charging aperture to allow charging of foodstuff into the container 1. The charging aperture is located in the rear of the container and is sealed with a charging lid 5 which defines a funnel shape in an open position. The charging lid 5 comprises two elements 6 and 7 that overlap each other. The elements 6 and 7 are each attached by hinging means to opposing edges of the charging aperture of the container 1.

In a closed position, elements 6 and 7 overlap each other, the upper-most element 6 forming an air-tight seal with the body of container 1. In the open position, the two elements 6 and 7 define a funnel shape through which the container 1 may be charged with a foodstuff.

Preferably, both elements 6 and 7 comprise gripping means for ease of opening.

The interior of the body is shaped such that there is no dead space at the access area. The interior floor is shaped to complement the shape of a scoop used to dispense foodstuff held in the container.

Referring to FIGS. 5 and 6, the components of the dampened hinging means 3 is preferably housed within a housing H which is defined by a cylindrical depression on the side of the body.

The dampened hinging means comprises a dampening means 8 and a pinion 9 which interacts with a rack 15 on an arm 14 of the access lid 2. In use, the dampening means 8 reduces the natural rate at which the access lid 2 lowers to the closed position. Rotation of the pinion 9 is resisted by the dampening means 8 which contains a substance with high viscosity such as silicon grease.

The pinion 9 and associated dampening means 8 are mounted on a carrier 10 within the housing H. The carrier device 10 comprises a disk having three circular apertures 11 that are spaced at different distances from the circumference of the disk 10 so that the disk may be used for three different size pinions 9*a*, 9*b* and 9*c* (FIG. 5).

The disk 10 comprises a plurality of apertures 12 located at the circumference for attaching an end cap 13 which protects the dampened hinging means 3.

When the access lid 2 is in the closed position, the rack 15 of the arm 14 is situated in a first position in front of the pinion, as indicated by arrow A in FIG. 5. As the access lid 2 is opened, the arm 14 is forced past the pinion 9, the rack 15 of the arm 14 interacts with the pinion 9 and causes the pinion 9 to turn. When the access lid 2 is in the open position, the rack 15 of the arm 14 is situated in a second position to the rear of the pinion 9, as indicated by arrow B in FIG. 6. As the access lid 2 is closed, the arm 14 is forced past the pinion 9, causing the pinion 9 to turn against the force of the dampening means 8 such that the access lid 2 is lowered to the closed position in a controlled manner.

Referring to FIG. 7, the pinion 9 and associated dampening means 8 are mounted on a carrier 10 which comprises a disk. An end cap 13 provides protection of the dampened hinging means from the outside environment.

FIG. 8 illustrates a plurality of containers 1 with access and charging lids shown in both open and closed positions. The container 1 may be produced in different sizes depending on the requirements of the retailer. FIG. 9 illustrates the three preferred sizes of the containers as 192 mm, 290 mm and 388 mm wide. The different sized containers would require different sized pinions 9 to achieve the same closing time.

The larger 388 mm wide container may require pinion 9*a* (see FIG. 5), whilst the smaller 192 mm container may require pinion 9*c* (see FIG. 5).

FIG. 10 illustrates a container 1 with a replaceable ticket strip 16, a scoop holder 17 and a scoop 18. The ticket strip 16 is an area suitable for displaying product information, and the scoop holder 17 and scoop 18 are preferably situated at the front of the container 1 below the access lid 2. To replace the ticket strip 16 in the embodiment illustrated, it is necessary to remove the scoop 18 and scoop holder 17 before removing the ticket strip 16. A new ticket strip 16 may then be inserted and the scoop holder 17 and scoop 18 repositioned.

FIG. 11 illustrates container 1 in the closed position from the front. The access lid 2 of the container has a handle 19 for users to open and close the container manually.

FIG. 12 illustrates a side elevation of container 1 with the access lid 2 and charging lid 5 in the closed positions. The body of the container 1 has a base which is adapted to be releasably attached to a display rack. The base is attached to a rack by projections 20 on the base.

FIG. 13 illustrates a display stand for holding a plurality of containers 1. Several different sized containers 1 may be held in the display stand, preferably the larger sized containers 1 are held at the bottom of the stand, while smaller sized containers are held at higher positions in the stand.

The body of the containers 1 preferably have flat sides so that a plurality of containers may be stacked side-by-side.

FIG. 14 illustrates the components of a display stand for holding a plurality of containers 1. The display stand comprises a rectangular shaped base frame having four supporting legs, two side panels and a back panel 24 having attachment means 25 for attaching a plurality of shelving brackets 26. The attachment means 25 are preferably slots for receiving prongs of shelving brackets 26. The shelving brackets 26 are adapted to support containers according to the invention.

The back panel is preferably curved to form a base for the display stand, a base extrusion and buffer 27 is placed over the front edge of the base. A spill tray 28 is located below the bottom shelf to catch any foodstuffs spilt by customers.

The display stand preferably has a gravity feed shelf 29 located near the top of the display stand which is adapted to support foodstuff containers of the type that dispense a foodstuff through an opening in the bottom of the container. A gravity feed spill tray 30 is located beneath the gravity feed shelf 29 to catch any foodstuff spilt while dispensing foodstuff from the gravity feed containers.

The display stand also has a top panel 31 adapted to display signage. The top panel 31 is preferably an aluminium light extrusion, with a reflector panel 32 attached. A fluorescent light is mounted in the top panel 31 to light up the signage and the display stand.

The invention claimed is:

1. A container for holding foodstuff, said container comprising a hollow body defining an internal space, and wherein said body has:

i) an access aperture to allow access to the internal space; and wherein the access aperture is sealed with an access lid; and wherein said access lid is connected by damped hinging means to said body; and wherein ii) a suction cup affixed thereto which is adapted to hold the access lid in an open position for a pre-determined period of time by forming a breakable seal with said access lid, wherein the body includes a charging aperture to allow the charging of foodstuff into the container, wherein said charging aperture is sealed with a charging lid which defines a funnel shape in an open position.

2. A container according to claim 1 wherein the charging lid comprises two elements that over-lap each other.

3. A container according to claim 2 wherein the upper element forms an airtight seal with the body of the container.

4. A container according to claim 1 wherein the body has an interior floor that is shaped to complement the shape of a scoop used to dispense foodstuff held in the container.

5. A container according to claim 1 wherein the body of the container has a front, a rear, two sides and a base.

6. A container according to claim 1 wherein the access aperture is located in the front of the body and the charging aperture is preferably located in the rear of the body.

7. A container according to claim 1 wherein the damped hinging means preferably comprises a damping means which co-operates with a pinion wherein said pinion interacts with an arm which is attached to the access lid, said arm having a rack on a longitudinal edge.

8. A container according to claim 7 wherein the rotation of the pinion is resisted by the damping means, which preferably contains a substance with high viscosity such as silicon grease.

9. A container according to claim 7 wherein the damping means and pinion are housed within a housing.

10. A container according to claim 9 wherein the housing is preferably defined by a cylindrical depression on the side of the body.

11. A container according to claim 7 wherein the pinion and associated damping means are preferably mounted on a carrier within the housing.

12. A container according to claim 10 wherein the carrier device comprises a disk including a plurality of circular apertures, each spaced at a different distance from the circumference of the disk so that the disk may be used for different sized pinions.

13. A container according to claim 12 wherein the disk comprises three circular apertures.

14. A container according to claim 1 wherein the base of the body is preferably adapted to be attached to a display rack.

15. A container according to claim 1 wherein the body of the container has flat sides so that a plurality of containers may be stacked side-by-side.

16. A container according to claim 1 wherein the top of the body of the container is curved.

17. A container according to claim 1 wherein the body of the container is adapted to house a scoop below the access lid.

18. A container according to claim 16 wherein the access lid forms an air-tight seal with the container in the closed position.

* * * * *